US008682225B2

(12) United States Patent
Takamatsu

(10) Patent No.: US 8,682,225 B2
(45) Date of Patent: Mar. 25, 2014

(54) IMAGE FORMING APPARATUS WITH PADDLE THAT AGITATES TONER SUPPLIED THROUGH FEED OPENING

(75) Inventor: Naritoshi Takamatsu, Kyoto (JP)

(73) Assignee: Murata Machinery, Ltd., Kyoto (JP)

( * ) Notice: Subject to any disclaimer, the term of this patent is extended or adjusted under 35 U.S.C. 154(b) by 246 days.

(21) Appl. No.: 13/272,722

(22) Filed: Oct. 13, 2011

(65) Prior Publication Data

US 2012/0114384 A1 May 10, 2012

(30) Foreign Application Priority Data

Nov. 4, 2010 (JP) ..... 2010-247533
Jun. 8, 2011 (JP) ..... 2011-128202

(51) Int. Cl.
*G03G 15/08* (2006.01)

(52) U.S. Cl.
USPC ..... 399/254; 399/256

(58) Field of Classification Search
USPC ..... 399/111, 119, 120, 252–263
See application file for complete search history.

(56) References Cited

U.S. PATENT DOCUMENTS

| | | | | |
|---|---|---|---|---|
| 4,855,783 | A * | 8/1989 | Takashima et al. | 399/256 |
| 4,878,088 | A * | 10/1989 | Nakanishi et al. | 399/119 |
| 5,867,756 | A | 2/1999 | Suzuki et al. | 399/255 |
| 7,409,170 | B2 * | 8/2008 | Mizuta | 399/27 |
| 2009/0087227 | A1 | 4/2009 | Takagi et al. | 399/263 |

FOREIGN PATENT DOCUMENTS

| | | |
|---|---|---|
| JP | 09-319201 | 12/1997 |
| JP | 2009-086505 | 4/2009 |
| JP | 2010-128250 | 6/2010 |

* cited by examiner

*Primary Examiner* — Hoan Tran
(74) *Attorney, Agent, or Firm* — DLA Piper LLP (US)

(57) ABSTRACT

An image forming apparatus includes: a photosensitive drum; a toner cartridge; and a developing unit that forms a toner image by visualizing a latent image formed on the photosensitive drum. The developing unit includes a feed opening through which toner is supplied from the toner cartridge, and a paddle that agitates toner supplied through the feed opening and feeds the toner in a direction of the photosensitive drum. The feed opening has an opening length shorter than a length in a direction of a rotary axis of the paddle, and the paddle includes a toner guide that diffuses the toner in the direction of the rotary axis of the paddle.

17 Claims, 6 Drawing Sheets

IMAGE FORMING APPARATUS WITH PADDLE THAT AGITATES TONER SUPPLIED THROUGH FEED OPENING

CROSS-REFERENCE TO RELATED APPLICATIONS

This application claims priority under 35 U.S.C. 119 to Japanese Patent Application No. 2010-247533, filed on Nov. 4, 2010 and No. 2011-128202, filed on Jun. 8, 2011, which applications are hereby incorporated by reference in their entireties.

BACKGROUND OF THE INVENTION

1. Field of the Invention

The present invention relates to an image forming apparatus provided with a developing unit that includes a feed opening through which toner is supplied from a toner cartridge and that visualizes a latent image formed on a photosensitive drum in order to form a toner image.

2. Description of the Related Art

In a developing unit provided in an image forming apparatus, after toner stored in the developing unit is decreased, toner is typically supplied to the developing unit from a toner cartridge. For example, toner may be supplied to the developing unit through a feed opening that is laterally provided in the developing unit, or through a feed opening that is provided in the top of the developing unit.

A paddle that agitates the supplied toner to feed the toner in a direction of a photosensitive drum may be provided in the developing unit. The paddle is configured to rotate about a rotary axis. The feed opening is provided only in a central portion in a direction of the rotary axis of the paddle and does not extend over the total length of the paddle. Because toner is supplied only from the central portion, an amount of toner is not evenly distributed in the axial direction, thereby generating unevenness. That is, a large amount of toner exists near the feed opening while small amounts of toner exist in both end portions in the axial direction. The uneven distribution of the toner is exhibited as unevenness in the density of the formed image, thereby degrading image quality.

Alternatively, the feed opening may be formed over substantially the total length in the direction of the rotary axis of the paddle. When the opening length of the feed opening is increased in this manner, the problem of uneven distribution of toner is solved. However, a shutter mechanism that opens and closes the feed opening must be enlarged, thereby generating a problem in the strength of the casing.

In view of the foregoing, an object of the present invention is to provide an image forming apparatus that can evenly diffuse toner without increasing the opening length of the feed opening.

SUMMARY OF THE INVENTION

In order to overcome the problems described above, the present invention provides an image forming apparatus including: a photosensitive drum; a toner cartridge; and a developing unit that forms a toner image by visualizing a latent image formed on the photosensitive drum. The developing unit includes a feed opening through which toner is supplied from the toner cartridge, and a paddle that agitates the toner supplied through the feed opening and feeds the toner in a direction of the photosensitive drum. The feed opening has an opening length shorter than a length in a direction of a rotary axis of the paddle, and the paddle includes a toner guide that diffuses the toner in the direction of the rotary axis of the paddle.

The working effect of the image forming apparatus having this configuration is as follows. In the developing unit provided in the image forming apparatus, the opening length of the feed opening is set shorter than the length in the direction of the rotary axis of the paddle. The toner supplied through the feed opening is agitated and fed by the rotation of the paddle. At this point, the paddle includes the toner guide that diffuses the toner in the direction of the rotary axis of the paddle. The toner supplied through the feed opening is also diffused toward both the end portions in the direction of the rotary axis, so that uneven distribution of the toner can be eliminated. As a result, the toner can be evenly diffused while the opening length of the feed opening is not increased.

In one embodiment, the toner guide is a fin. When the toner guide is formed into a fin shape, the toner guide and the paddle can integrally be formed, and a new function is added while cost is suppressed.

In one embodiment, the feed opening is opened upward, the toner in the toner cartridge drops through the feed opening, and the toner is supplied to the developing unit.

Accordingly, the toner is caused to drop from above, so that the toner can be supplied into developing unit by a simple configuration.

In one embodiment, the feed opening is disposed in a central portion in the direction of the rotary axis of the paddle, and the toner guide diffuses the toner toward both end portions in the direction of the rotary axis.

Accordingly, the feed opening is disposed in the central portion in the direction of the rotary axis, and the toner is diffused from the central portion toward both end portions (one end portion and the other end portion) in an axial direction. The toner is thereby substantially evenly diffused toward one end portion and the other end portion, so that the toner is evenly distributed.

Other features, elements, processes, steps, characteristics and advantages of the present invention will become more apparent from the following detailed description of embodiments of the present invention with reference to the attached drawings.

DETAILED DESCRIPTION OF EMBODIMENTS OF THE INVENTION

Figure 1:
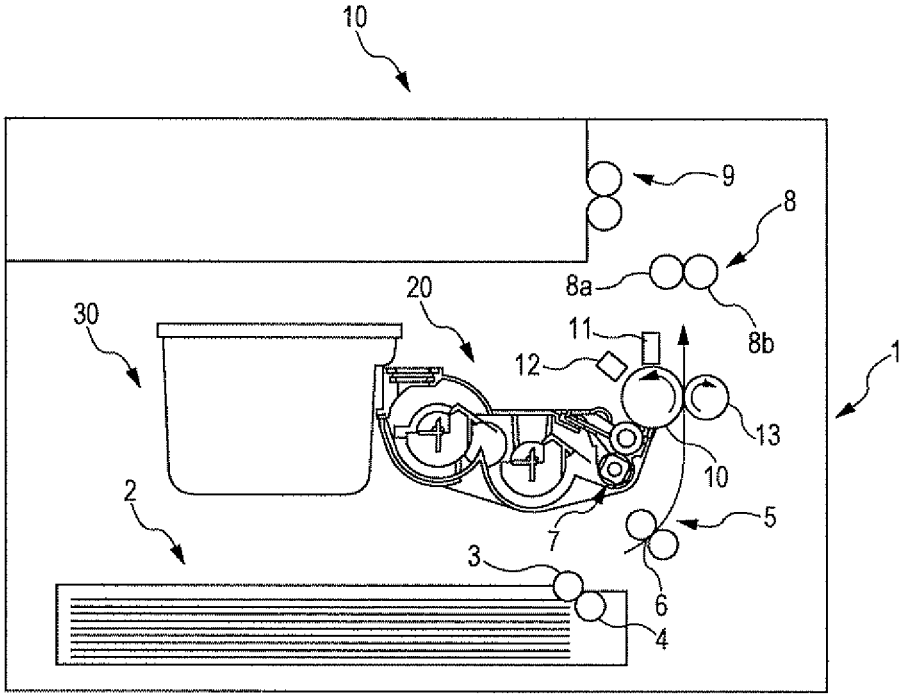
FIG. 1 is a sectional view conceptually illustrating an internal configuration of an image forming apparatus.

An image forming apparatus according to an embodiment of the invention is described below with reference to the drawings. An image forming apparatus 1 illustrated in FIG. 1 is a printer provided with an electrophotographic image recording unit. Alternatively, the image forming apparatus 1 may be configured as a copying machine or a facsimile apparatus, in which an image reading unit is added to the image recording unit, and what is called a multifunction peripheral in which the copying machine and a facsimile apparatus are combined. In the image forming apparatus 1 of FIG. 1, a supply unit 2 that supplies a recording sheet (paper) is provided in a lower portion, and an electrophotographic image forming unit 7 and a paper discharge unit that discharges the already-recorded recording sheet are provided above the supply unit 2.

<Entire Configuration of Image Forming Apparatus>

Stacked recording sheets are stored in the supply unit 2, and a pick-up roller 3 and a retard roller 4 feeds the recording sheets one by one. The fed recording sheet is introduced to a feed path 6, and a feed roller 5 further delivers the recording sheet onto a downstream side. The image forming unit 7 is disposed on the feed path 6, forms a toner image on the recording sheet and delivers the recording sheet to a fuser unit 8. A heat roller 8*a* and a press roller 8*b*, which constitute the fuser unit 8, provide heat and pressure to the recording sheet to fix the toner image onto the recording sheet. An exit roller 9 discharges the recording sheet to a paper exit tray 10, thereby ending the process of forming the image on the recording sheet.

The image forming unit 7 is described below. A photosensitive drum 10 (corresponding to an image bearing body) is provided in the image forming unit 7 and rotates counterclockwise (direction of the arrow) during image formation. A charger unit 11, an exposure unit 12, a developing unit 20, and a transfer roller 13 are disposed in this order along the rotating direction of the photosensitive drum 10. The surface of the photosensitive drum 10 is exposed by the exposure unit 12 after being charged by the charger unit 11 to form a latent image on the surface of the photosensitive drum 10. The developing unit 20 then visualizes the latent image with the toner. When the recording sheet reaches a nip position between the transfer roller 13 and the photosensitive drum 10, a bias voltage is applied to the transfer roller 13, and the toner image on the outer surface of the photosensitive drum 10 is electrically attracted to the recording sheet. Therefore, the image is formed on the recording sheet. A toner cartridge 30 is provided adjacent to the developing unit 20.

<Configuration of Developing Unit>

Figure 2:
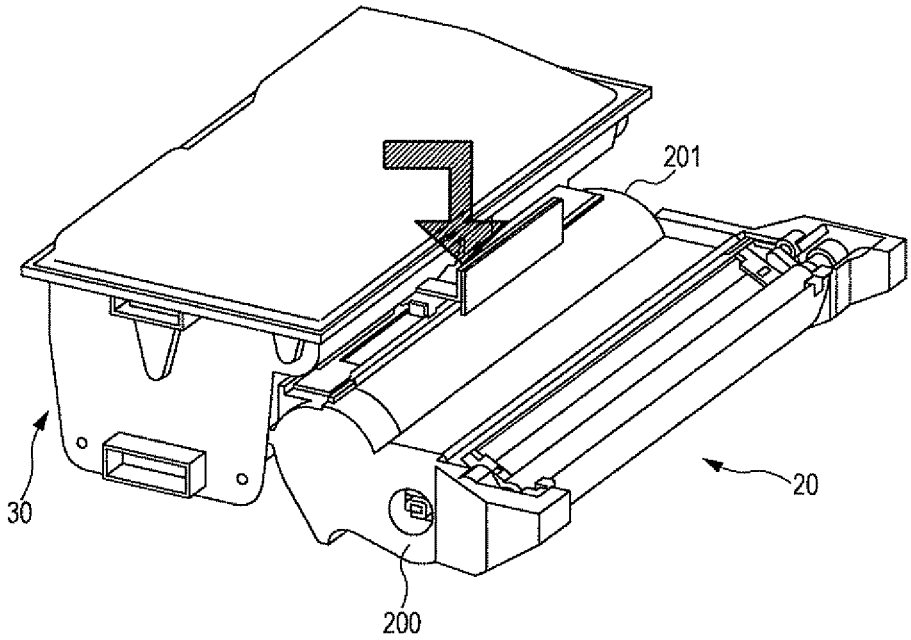
FIG. 2 is a perspective view of a state in which a developing unit and a toner cartridge are coupled.
Figure 3:
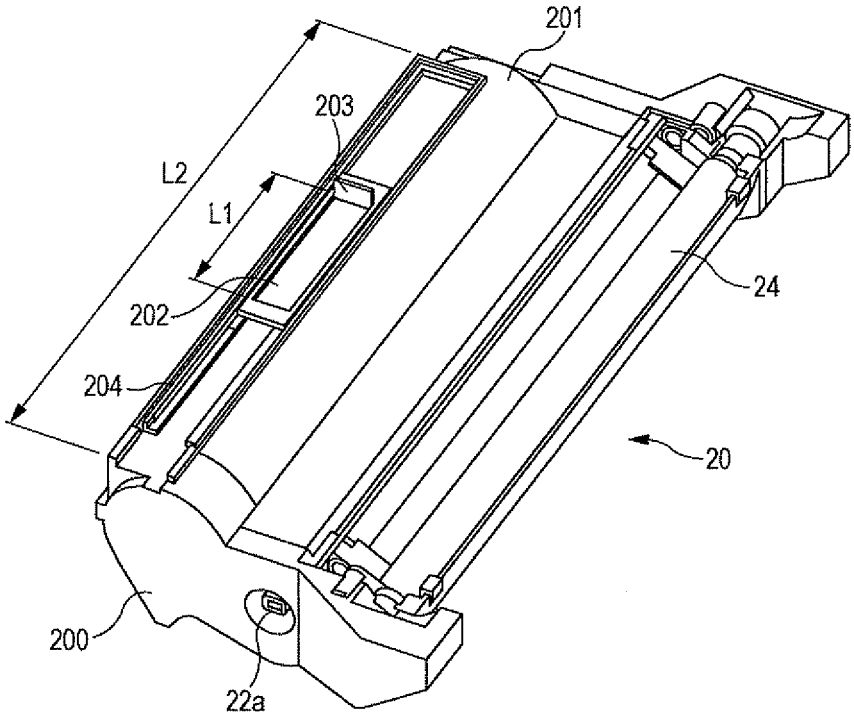
FIG. 3 is a perspective view of the developing unit.
Figure 4:
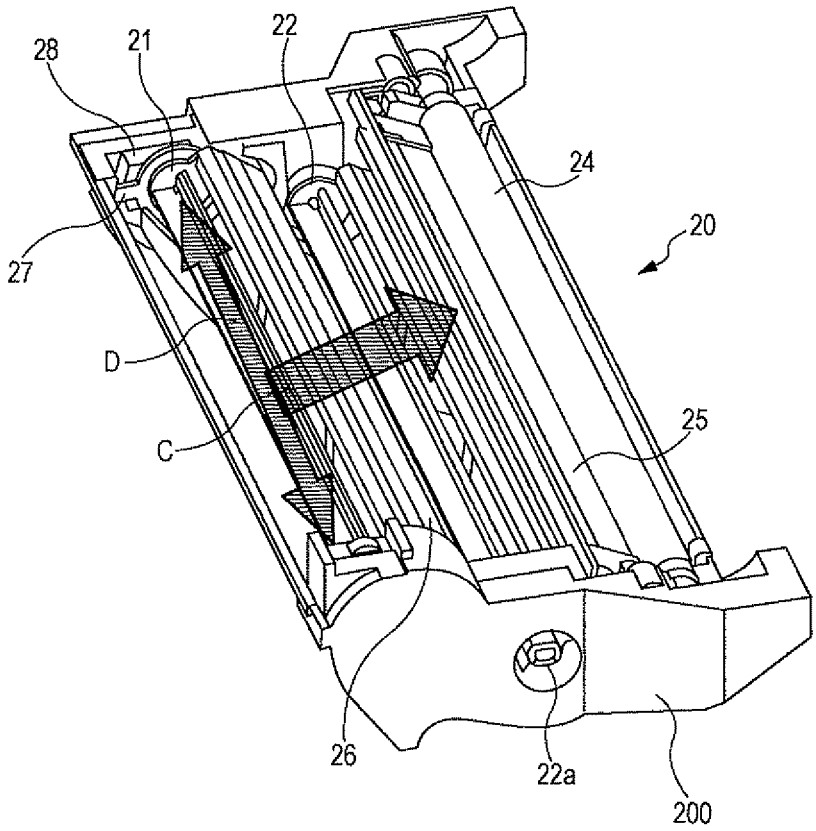
FIG. 4 is a perspective view of an internal configuration of the developing unit.
Figure 5:
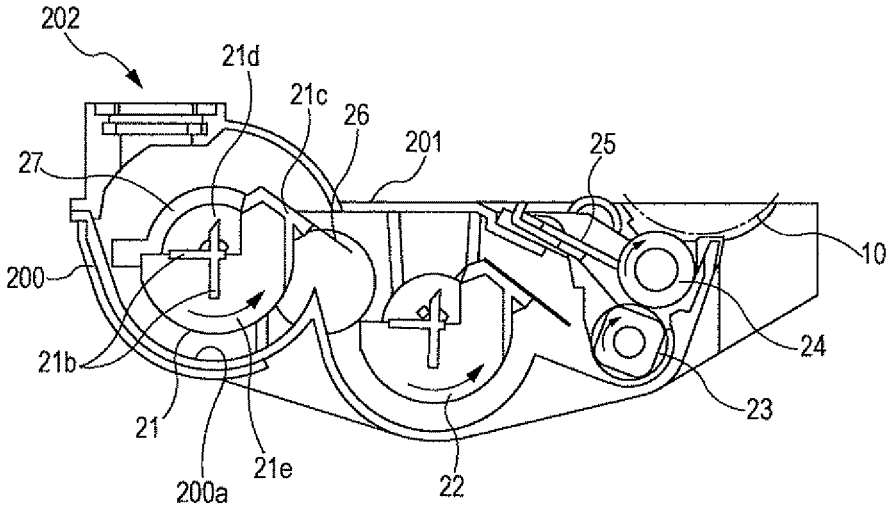
FIG. 5 is a sectional view of an internal configuration of the developing unit.
Figure 6A:
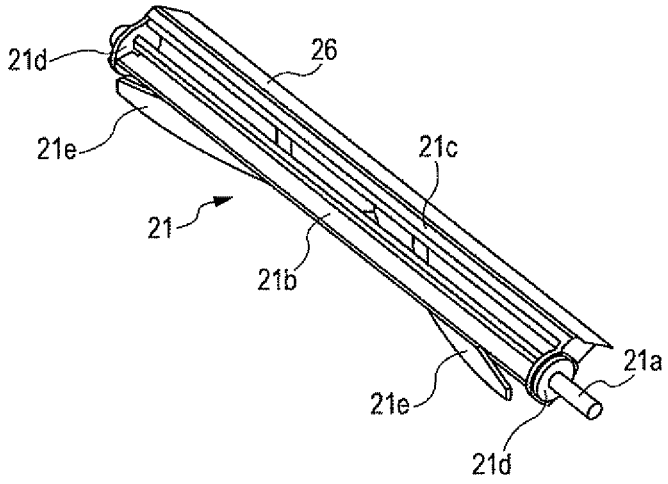
FIG. 6A is a perspective view of a paddle.
Figure 6B:
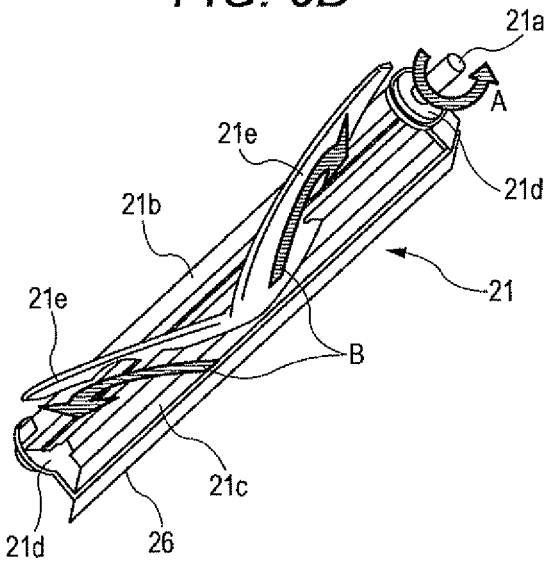
FIG. 6B is a perspective view of the paddle when viewed from a side on which a fin is formed.

A configuration of the developing unit 20 is described below. FIG. 2 is a perspective view of a state in which the developing unit 20 and the toner cartridge 30 are coupled. FIG. 3 is a perspective view of the developing unit 20. FIG. 4 is a perspective view of an internal configuration of the developing unit 20. FIG. 5 is a sectional view of the internal configuration of the developing unit. FIGS. 6A and 6B are perspective views of a paddle.

In the developing unit 20, non-magnetic monocomponent toner (hereinafter simply referred to as toner) is stored as a developer in a casing 200. A casing cover 201 is attached onto an upper side of the casing 200. Supply toner is stored in the toner cartridge 30, and the toner cartridge 30 is disposed adjacent to the developing unit 20 in a horizontal direction.

A feed opening 202 through which toner is supplied from the toner cartridge 30 is illustrated in FIG. 3. Preferably an opening length L1 in a longitudinal direction of the feed opening 202 is set to ¼ to ½ of a total length L2. In the example of FIG. 3, the opening length L1 is set to about ⅓ of the total length L2. The feed opening 202 is located in a central portion in the longitudinal direction. A shutter member 203 is provided in the feed opening 202 and is usually closed before the toner cartridge 30 is attached. When the toner cartridge 30 is attached along a slide rail 204 provided on the side of the developing unit 20, the shutter member 203 moves to open the feed opening 202.

As illustrated in FIG. 5, a first paddle 21, a second paddle 22, a supply roller 23, and a developing roller 24 are rotatably attached in the developing unit 20. The outer surface of the supply roller 23 is constructed by a foamed member or a brush to supply toner to the surface of the developing roller 24. The outer surface of the developing roller 24 is disposed in contact with the outer surface of the photosensitive drum 10, or is disposed while separated from the outer surface of the photosensitive drum 10 with a slight gap.

The supply roller 23 rotates in a clockwise direction of FIG. 5, and supplies toner to the surface of the developing roller 24, which also rotates in the clockwise direction of FIG. 5. A leading end of a flexible blade 25 contacts the surface of the developing roller 24 and makes an adjustment such that the toner on the surface of the developing roller 24 becomes a thin film having an even thickness. Using the thin film of the toner formed on the surface of the developing roller 24, the latent image formed on the surface of the photosensitive drum 10 is visualized to form the toner image. Residual toner that does not contribute to formation of the toner image is returned to and recovered by the developing unit 20. Alternatively, a cleaner may separately be provided to remove the toner remaining on the surface of the photosensitive drum 10.

Because the first paddle 21 and the second paddle 22 basically have the same shape, only the first paddle 21 is described. When the first paddle 21 can sufficiently rotate the toner, a fin may not be provided in the second paddle 22. FIG. 6A is a perspective view of the first paddle 21, and FIG. 6B is a perspective view of the first paddle 21 when viewed from the side on which the fin is formed.

The first paddle 21 includes a rotary shaft 21*a*, and ribs 21*b* extending radially around the rotary shaft 21*a*. Support discs 21*d* are provided in both end portions in the longitudinal direction of the ribs 21*b*, and the rotary shaft 21*a* is provided out of the support disc 21*d*. An attaching rib 21*c* is longitudinally formed in a circumferential portion of the first paddle 21 in order to attach a film 26. The film 26 is a resin sheet. When the first paddle 21 rotates, the film 26 delivers the toner in a direction of the photosensitive drum 10.

Two fins 21*e* are formed in a central portion of the attaching rib 21*c* and extend toward both end portions. As illustrated in FIG. 6B, the first paddle 21 rotates in the direction of arrow A to diffuse the toner in the direction of arrow B. The toner supplied from the feed opening 202 in the central portion is diffused to both end portions in an axial direction of the first paddle 21, which allows the toner to be evenly dispersed.

The rotary shaft 21*a*, the rib 21*b*, the attaching rib 21*c*, the support disc 21*d*, and the fin 21*e* of the first paddle 21 are formed by monolithic molding using a resin. Although two fins 21*e* are illustrated in FIG. 6, more than two fins may be provided.

As illustrated in FIG. 4, a rotary shaft 22*a* of the second paddle 22 is exposed from the casing 200 and coupled to a drive mechanism. The drive mechanism including a gear is provided in the casing 200 such that the first paddle 21, the supply roller 23, and the developing roller 24 rotate while interlocking with the rotation of the second paddle 22.

A scraper 27 is provided in an end portion in an axial direction of the first paddle 21 and has a function of cleaning a transparent detected unit 28. A toner sensor is provided out of the casing 200 in order to detect the existence or non-existence of toner. The scraper 27 and the first paddle 21 rotate integrally, and the scraper 27 cleans the detected unit 28, such that the toner sensor can correctly detect toner.

As illustrated in FIG. 5, and where r is a radius of the fin 21*e* of the first paddle 21 and R is a radius of an inner wall surface of the casing 200 to which the first paddle 21 is attached, a relationship between the radii r and R is preferably set to 0.6 R≤r≤0.8 R. Toner feeding power is decreased when R−r is excessively large. When R−r is excessively small, damage to the toner is increased, and a rotary torque of the first paddle 21 is increased.

A mechanism is provided in the toner cartridge 30 to agitate and feed the toner, thereby supplying the toner from the feed opening 202 in proper timing. As illustrated in FIG. 4, when the first paddle 21 and the second paddle 22 rotate, the toner is diffused in a direction of arrow D (a direction of a rotary axis) while being fed in a direction of arrow C. Therefore, uneven distribution of the toner can be eliminated.

In the embodiment, the toner cartridge 30 is disposed adjacent to the developing unit 20 in a horizontal direction. However, the disposition of the toner cartridge 30 is not limited to the horizontal direction, and the toner cartridge 30 may for example be disposed above the developing unit 20.

In the embodiment, the fins that are of the toner guide and the paddle are formed by the monolithic molding. Alternatively, the fins may be separately formed and attached to the main body of the paddle.

While the present invention has been described with respect to embodiments thereof, it will be apparent to those skilled in the art that the disclosed invention may be modified in numerous ways and may assume many embodiments other than those specifically set out and described above. Accordingly, the appended claims are intended to cover all modifications of the present invention that fall within the true spirit and scope of the present invention.

What is claimed is:

1. An image forming apparatus comprising:
a photosensitive drum;
a toner cartridge; and
a developing unit that that forms a toner image by visualizing a latent image formed on the photosensitive drum, the developing unit including:
a feed opening through which toner is supplied from the toner cartridge, and
a paddle that agitates the toner supplied through the feed opening, and feeds the toner in a direction of the photosensitive drum, wherein
the feed opening has an opening length shorter than a length in a direction of a rotary axis of the paddle,
the paddle includes a toner guide that diffuses the toner in the direction of the rotary axis of the paddle,
the toner guide is a fin, and
the following relationship is satisfied:

$$0.6R \le r \le 8R$$

where r is a radius of the fin and R is a radius of an inner wall surface of a casing of the developing unit.

2. The image forming apparatus according to claim 1, wherein the feed opening is opened upward, the toner in the toner cartridge drops in the developing unit through the feed opening, and the toner is supplied from the toner cartridge to the developing unit.

3. An image forming apparatus comprising:
a photosensitive drum;
a toner cartridge; and
a developing unit that that forms a toner image by visualizing a latent image formed on the photosensitive drum, the developing unit including:
a feed opening through which toner is supplied from the toner cartridge, and
a paddle that agitates the toner supplied through the feed opening, and feeds the toner in a direction of the photosensitive drum, wherein
the feed opening has an opening length shorter than a length in a direction of a rotary axis of the paddle,
the paddle includes a toner guide that diffuses the toner in the direction of the rotary axis of the paddle,
the toner guide is a fin, and
the fin and the paddle are formed by monolithic molding.

4. The image forming apparatus according to claim 3, wherein the following relationship is satisfied:

$$0.6R \le r \le 8R$$

where r is a radius of the fin and R is a radius of an inner wall surface of a casing of the developing unit.

5. An image forming apparatus comprising:
a photosensitive drum;
a toner cartridge; and
a developing unit that that forms a toner image by visualizing a latent image formed on the photosensitive drum, the developing unit including:
a feed opening through which toner is supplied from the toner cartridge, and
a paddle that agitates the toner supplied through the feed opening, and feeds the toner in a direction of the photosensitive drum, wherein
the feed opening has an opening length shorter than a length in a direction of a rotary axis of the paddle,
the paddle includes a toner guide that diffuses the toner in the direction of the rotary axis of the paddle,
the feed opening is disposed in a central portion in the direction of the rotary axis of the paddle, and
the toner guide diffuses the toner toward both end portions in the direction of the rotary axis.

6. The image forming apparatus according to claim 5, wherein two fins are formed in a central portion of the paddle and extend toward both end portions, such that toner supplied from the feed opening in the central portion is diffused to both end portions.

7. An image forming apparatus comprising:
a photosensitive drum;
a toner cartridge; and
a developing unit that that forms a toner image by visualizing a latent image formed on the photosensitive drum, the developing unit including:
a feed opening through which toner is supplied from the toner cartridge, and
a paddle that agitates the toner supplied through the feed opening, and feeds the toner in a direction of the photosensitive drum, wherein
the feed opening has an opening length shorter than a length in a direction of a rotary axis of the paddle,
the paddle includes a toner guide that diffuses the toner in the direction of the rotary axis of the paddle, and
the opening length of the feed opening is in a range of ¼ to ½ of the length in the direction of the rotary axis of the paddle.

8. The image forming apparatus according to claim 7, wherein the opening length of the feed opening is about ⅓ of the length in the direction of the rotary axis of the paddle.

9. An image forming apparatus comprising:
a photosensitive drum;
a toner cartridge; and
a developing unit that that forms a toner image by visualizing a latent image formed on the photosensitive drum, the developing unit including:
a feed opening through which toner is supplied from the toner cartridge, and a paddle that agitates the toner supplied through the feed opening, and feeds the toner in a direction of the photosensitive drum, wherein the feed opening has an opening length shorter than a length in a direction of a rotary axis of the paddle, the paddle includes a toner guide that diffuses the toner in the direction of the rotary axis of the paddle, and a shutter member is provided in the feed opening and moves to open or close the feed opening.

10. An image forming apparatus comprising:

a photosensitive drum;

a toner cartridge; and a developing unit that that forms a toner image by visualizing a latent image formed on the photosensitive drum, the developing unit including;

a feed opening through which toner is supplied from the toner cartridge, and a paddle that agitates the toner supplied through the feed opening, and feeds the toner in a direction of the photosensitive drum, wherein the feed opening has an opening length shorter than a length in a direction of a rotary axis of the paddle, the paddle includes a toner guide that diffuses the toner in the direction of the rotary axis of the paddle, and wherein the paddle comprises:

a rotary shaft;

ribs extending radially around the rotary shaft;

support discs in both end portions in a longitudinal direction of the ribs;

an attaching rib longitudinally formed in a circumferential direction of the paddle;

a film attached to the attaching rib; and two fins formed in a central portion of the attaching ribs and extending toward both end portions, the fins comprising the toner guide.

11. An image forming apparatus comprising:

a photosensitive drum a toner cartridge; and a developing unit that that forms a toner image by visualizing a latent image formed on the photosensitive drum, the developing unit including:

a feed opening through which toner is supplied from the toner cartridge, a first paddle that agitates the toner supplied through the feed opening, and feeds the toner in a direction of the photosensitive drum, and a second paddle having the same construction as the first paddle, wherein the feed opening has an opening length shorter than a length in a direction of a rotary axis of the first paddle, and the first paddle includes a toner guide that diffuses the toner in the direction of the rotary axis of the first paddle.

12. An image forming apparatus comprising:

a photosensitive drum;

a toner cartridge; and a developing unit that that forms a toner image by visualizing a latent image formed on the photosensitive drum, the developing unit including:

a feed opening through which toner is supplied from the toner cartridge, a paddle that agitates the toner supplied through the feed opening, and feeds the toner in a direction of the photosensitive drum, a transparent detected unit having a toner sensor that detects the existence or non-existence of toner; and a scraper that rotates integrally with the paddle to clean the transparent detected unit such that the toner sensor correctly detects toner, wherein the feed opening has an opening length shorter than a length in a direction of a rotary axis of the paddle, and the paddle includes a toner guide that diffuses the toner in the direction of the rotary axis of the paddle.

13. A developing unit for an image forming apparatus comprising:

a feed opening through which toner is supplied to the developing unit; and a paddle that agitates and feeds the toner supplied through the feed opening, wherein the feed opening has an opening length shorter than a length in a direction of a rotary axis of the paddle, the paddle includes a toner guide that diffuses the toner in the direction of the rotary axis of the paddle, and the toner guide is a fin, and the relationship $0.6R \leq r \leq 8R$ is satisfied, where r is a radius of the fin and R is a radius of an inner wall surface of a casing of the developing unit.

14. The developing unit according to claim 13, wherein the feed opening is disposed in a central portion in the direction of the rotary axis of the paddle, and two fins are formed in a central portion of the paddle and extend toward both end portions, such that toner supplied from the feed opening in the central portion is diffused to both end portions.

15. A developing unit for an image forming apparatus comprising:

a feed opening through which toner is supplied to the developing unit; and a paddle that agitates and feeds the toner supplied through the feed opening, wherein the feed opening has an opening length shorter than a length in a direction of a rotary axis of the paddle, the paddle includes a toner guide that diffuses the toner in the direction of the rotary axis of the paddle, and the opening length of the feed opening is about ⅓ of the length in the direction of the rotary axis of the paddle.

16. A paddle for agitating and feeding toner in a developing unit of an image forming apparatus, the paddle comprising:

a rotary shaft;

ribs extending radially around the rotary shaft;

support discs in both end portions in a longitudinal direction of the ribs;

an attaching rib longitudinally formed in a circumferential direction of the paddle;

a film attached to the attaching rib; and two fins formed in a central portion of the attaching ribs and extending toward both end portions.

17. The paddle according to claim 16, wherein the rotary shaft, the ribs, the attaching rib and the two fins are formed by monolithic molding using a resin.

* * * * *